US009642210B2

(12) United States Patent
Farley

(10) Patent No.: US 9,642,210 B2
(45) **Date of Patent: *May 2, 2017**

(54) SUPERVISION FOR A LIGHT DISPLAY DEVICE

(71) Applicant: Tyco Fire & Security GmbH, Neuhausen am Rheinfalll (CH)

(72) Inventor: Joseph D. Farley, Warwick, MA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 500 days.

This patent is subject to a terminal disclaimer.

(21) Appl. No.: 14/075,157

(22) Filed: Nov. 8, 2013

(65) Prior Publication Data

US 2014/0062491 A1 Mar. 6, 2014

Related U.S. Application Data

(63) Continuation of application No. 12/885,047, filed on Sep. 17, 2010, now Pat. No. 8,614,550.

(51) Int. Cl.
*H05B 37/00* (2006.01)
*H05B 33/08* (2006.01)

(52) U.S. Cl.
CPC ..... *H05B 33/0884* (2013.01); *H05B 33/0818* (2013.01); *H05B 33/0848* (2013.01); *H05B 33/0869* (2013.01)

(58) Field of Classification Search
CPC H05B 33/0815; H05B 37/02; H05B 33/0818; H05B 41/2828
USPC ..... 315/291, 307, 308, 246–247
See application file for complete search history.

(56) References Cited

U.S. PATENT DOCUMENTS 5,803,579 A * 9/1998 Turnbull ..... B60L 1/14 257/E25.02
2006/0237636 A1* 10/2006 Lyons ..... F21K 9/00 250/228
2010/0148677 A1* 6/2010 Melanson ..... H05B 33/0869 315/154
2010/0171442 A1* 7/2010 Draper ..... H05B 33/0872 315/297
2010/0174345 A1* 7/2010 Ashdown ..... A61N 5/0618 607/88

* cited by examiner

*Primary Examiner* — Minh D A

(57) ABSTRACT

A device and method may include, in a display device, emitting visible light in a humanly imperceptible manner and sensing said light to verify operation of the display device.

27 Claims, 4 Drawing Sheets

SUPERVISION FOR A LIGHT DISPLAY DEVICE

CROSS-REFERENCE TO RELATED APPLICATIONS

This is a continuation of co-pending U.S. non-provisional patent application Ser. No. 12/885,047, filed Sep. 17, 2010, the entirety of which application is incorporated by reference herein.

FIELD OF THE INVENTION

Embodiments of the present disclosure relate to supervision for a light display device. More particularly, the present disclosure relates to activating a LED wherein light emitted by the activated LED is imperceptible to a human, determining whether the LED failed to operate and reporting a failure to operate.

BACKGROUND OF THE INVENTION

The light emitting diodes (LED) inside a light display device must be tested periodically to ensure that the lights adhere to certain standards. In one example, LEDs in a light display device used in an emergency situation must be tested annually to ensure that all the LEDs are functional.

Currently, the most common way to test a light display device is for a user to flash on and off the lights and to visually check that all the LEDs are functional and/or synchronized. However, this method is time consuming as it requires manual testing and observation. Additionally, the testing of the LEDs inside the devices is disruptive and distracting to others, such as patients and staff at a hospital. As a result, there is a desire to check the proper functioning of the LEDs without causing a disruption.

SUMMARY OF THE INVENTION

Exemplary embodiments of the present disclosure are directed to supervision for a light display device. In an embodiment, a light display device may include a LED emitting light in response to power supplied thereto. A photodetector may be disposed with the LED. The photodetector may be configured to detect intensity of light emitted from the LED and generate an electrical signal for the light emitted from the LED. A control circuit may be connected to the LED and the photodetector. The control circuit may be configured to activate the LED for an amount of time imperceptible to a human, receive the electrical signal from said photodetector and determine whether the LED is operational.

In an embodiment, a device may include a LED, a driver circuit and a microcontroller. The driver circuit may be connected to the LED. The driver circuit may be configured to activate the LED wherein the activated LED is unable to be detected by a human. The microcontroller may be connected to the driver circuit and the LED. The microcontroller may be configured to receive an indication when the LED is activated, obtain results of the activation and determine whether the LED is operational.

In an embodiment, a method may include activating the LED in a light display device to emit an intensity of light in response to supplied power. Light emitted by the activated LED may be imperceptible or undetectable to a human. It may be determined whether the LED failed to operate based on the intensity of light of the activated LED. A failure to operate of the LED may be reported.

DETAILED DESCRIPTION

Various embodiments may be generally directed to humanly imperceptible or undetectable light emitting diode supervision for a light display device. In one embodiment, for example, each of the one or more LEDs in a light display device may be activated. The LED may be activated for a flash which is so short as to be imperceptible to a human. Alternatively, or in addition, the current supplied to the LED may be reduced to a percentage of the normal drive current to reduce the intensity of the activated LED. The reduced light intensity may be imperceptible to a human. It may be determined whether any of the one or more LEDs failed to operate. If any of the LEDs failed to operate, a failure may be reported.

By having a microcontroller flash the one or more LEDs so quickly that the light is not seen by a human and/or by reducing the current supplied to the LED so that the light is not perceivable or detectable by a human, the testing of the LEDs in the light display device is not disruptive to others.

Other embodiments may be described and claimed. Various embodiments may comprise one or more elements. An element may comprise any structure arranged to perform certain operations. Each element may be implemented as hardware, software, or any combination thereof, as desired for a given set of design parameters or performance constraints. Although an embodiment may be described with a limited number of elements in a certain topology by way of example, the embodiment may include more or less elements in alternate topologies as desired for a given implementation. It is worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
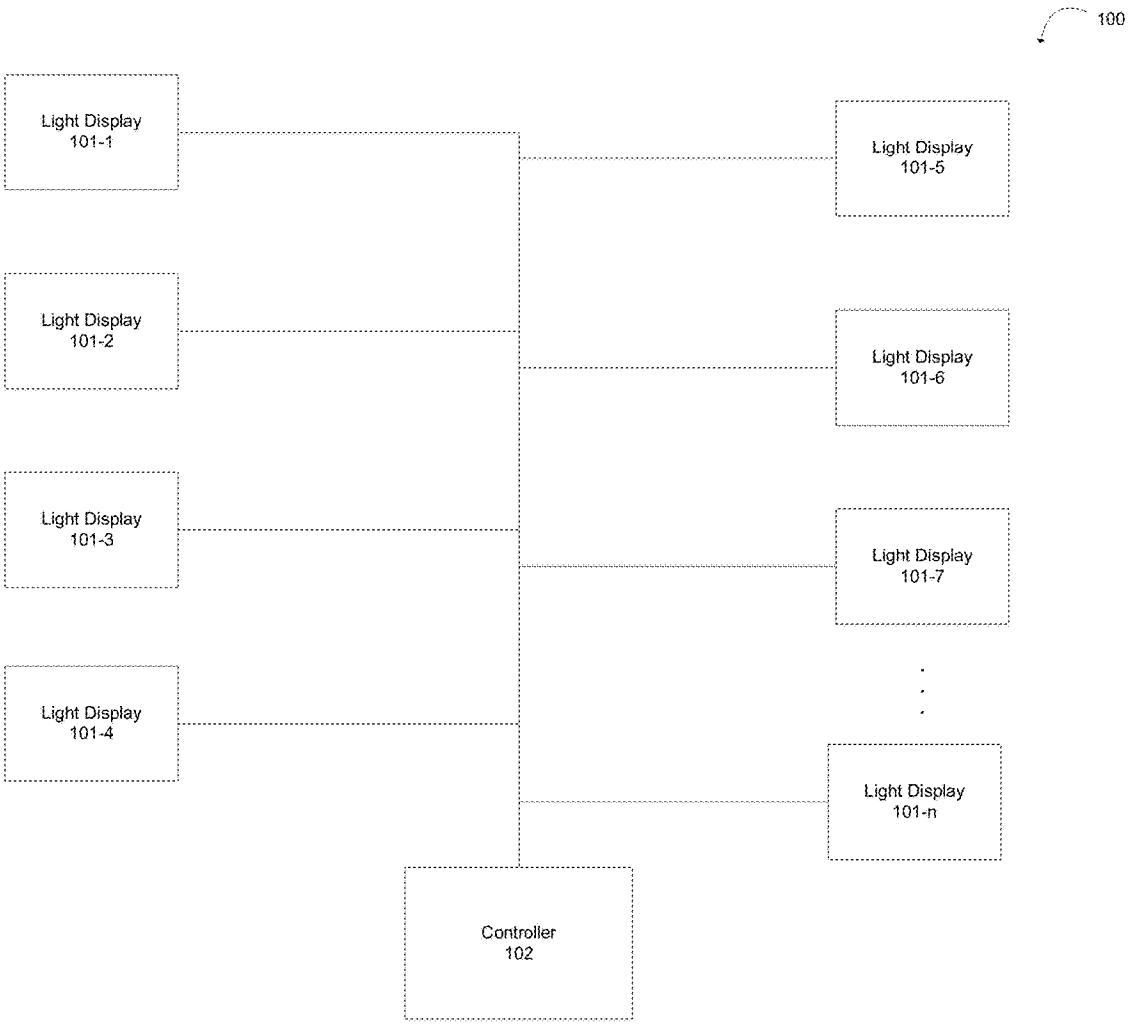
FIG. 1 illustrates one embodiment of a system using light display devices.

FIG. 1 illustrates one embodiment of a system using a plurality of light display devices. FIG. 1 is a block diagram illustrating a location 100 with a plurality of light display devices 101-1-101-n. The light display devices 101-1 through 101-n may be dome light display devices, fire alarm strobe light devices, notification light display devices or other types of light display devices. Although FIG. 1 may show a limited number of nodes by way of example, it can be appreciated that more or less light display devices may be employed for a given implementation.

The location 100 may include, but is not limited to, a hospital, a doctor's office, dressing rooms in a department store, a nursing home, an office and/or other locations.

As shown in FIG. 1, the location 100 may include one or more light display devices 101-1 through 101-n. For example, each light display device may be outside a patient's room in a hospital 100. Each light display device may be connected to a controller 102. A controller 102 may signal for a light display device to activate. The control of the light display device may be local to the light display device. For example, there may be an alarm device that communicates a signal directly to the light display device instead of through a centrally located controller. The power supplied to the light display device may come from a variety of sources, such as, but not limited to, a controller or one or more batteries.

The power supplied to the one or more light emitting diodes (LEDs) within the light display device may cause the LED to emit light. For example, each light display device may include a plurality of white, red, green and/or blue (RGB) LEDs. The light display device may display a specific color to indicate a type of service needed for the room. Based on the situation in a patient's room, information may be sent to a light display device 101-n to output a particular color.

The light display device may be a fire alarm strobe light. The LEDs in a fire alarm strobe light display may pulse or flash to alert people of a fire or other emergency. The information may be sent by the controller 102, by an alarm and/or another device. As the LEDs within the light display devices may be used to indicate actions that need to be taken, there is a need to ensure that all the lights are functional.

Figure 2:
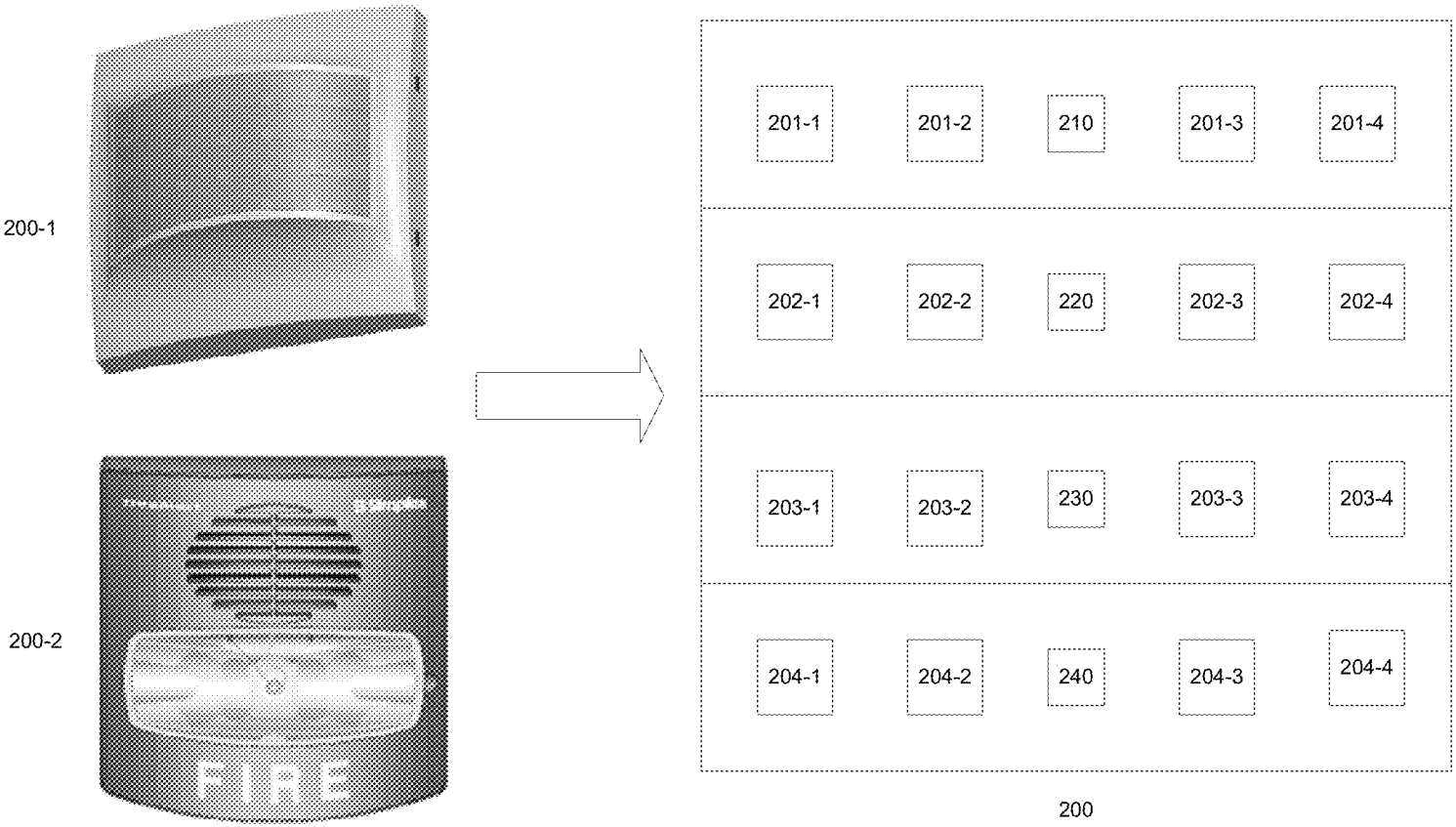
FIG. 2 illustrates one embodiment of a light display.

FIG. 2 illustrates one embodiment of a light display device. As shown in FIG. 2, the light display device 200 may include at least a dome light display device 200-1 or a fire alarm strobe light display device 200-2. The light display device 200 may have, for example, one or more rows with one or more LEDs in each row. Other configurations are within the scope of the invention. The light display device may include four segments or color bar rows where each row 201, 202, 203 and 204, may be used to display a particular color. The first row may include one or more white LEDs and/or one of the other rows may also include one or more white LEDs. This is because a location may use a white output light frequently and may want to have one or more rows dedicated to white light. For example, in FIG. 2, the first row may have four white LEDs 201-1, 201-2, 201-3 and 201-4. Multiple rows may be filled with one or more white and/or red, green, blue (RGB) LEDs. Each RGB LED may include a package with three components; a first component may be a red light, a second component may be a green light and a third component may be a blue light.

Alternatively, there may be multiple single-color LEDs of each color. The second row of the light emitting diode may have four LEDs 202-1, 202-2, 202-3, 202-4. The third row may have four LEDs 203-1, 203-2, 203-3, 203-4 and the fourth row may have four LEDs 204-1, 204-2, 204-3, 204-4. The above embodiments are not limited to the number of LEDs described above.

Figure 3:
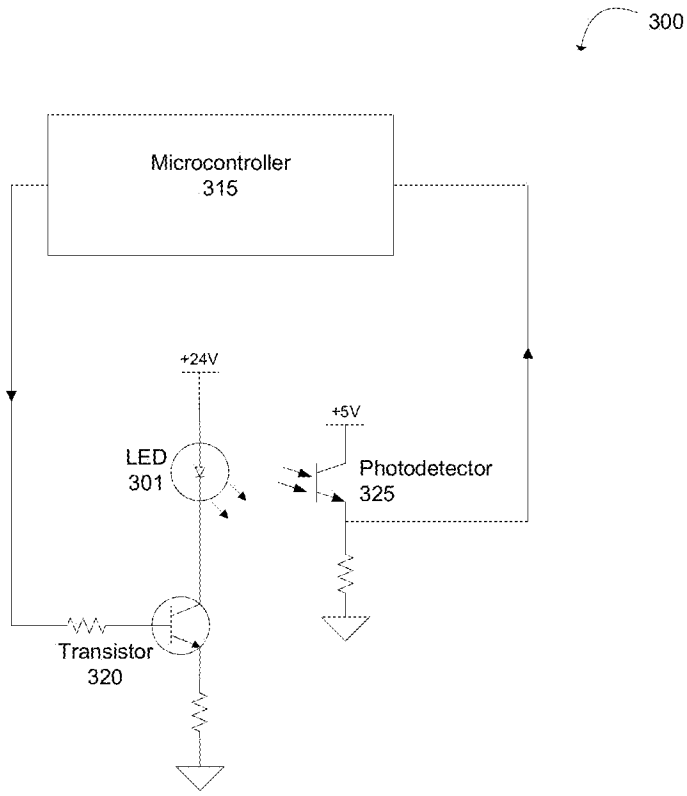
FIG. 3 illustrates one embodiment of the circuitry for imperceptible supervision.

Each row of the light display device may have photodetector 210, 220, 230 and 240. A photodetector 210, 220, 230 and 240 may be disposed with one or more LEDs in each row. Alternatively, there may be one photodetector 210 per LED, or per pair of LEDs, etc. A photodetector 210, 220, 230 and 240 may be used to individually measure the output intensity of each LED. FIG. 3 more fully depicts the measurement of power by the photodetector 210, 220, 230 and 240. The various white and/or RGB LEDs within a row may be the same color so that more light is output from the dome light display device. Each LED may be activated individually, simultaneously and the one or more LEDs within a row may be turned on and/or off together.

The photodetector 210, 220, 230 and 240 measures the output intensity of the group of LEDs with which it is associated to determine if each LED of its group is functional. A photodetector 210, 220, 230 and 240 may include, but is not limited to, a photodiode, a phototransistor, a charge-coupled device (CCD) and/or another light sensor or electromagnetic energy sensor. The photodetector 210, 220, 230 and 240 may measure the output intensity of each LED individually or the photodetector 210, 220, 230 and 240 may measure the output intensity of some or all of the LEDs collectively. The photodetector 210, 220, 230 and 240 may be configured to detect the intensity of light emitted from the LEDs and generate an electrical signal proportional to the light emitted from the LEDs.

FIG. 3 illustrates one embodiment of the circuitry for imperceptible supervision. FIG. 3 depicts an LED 301, a photodetector and a control circuit. The control circuit may include a diver circuit 320 and a microcontroller 315. The circuitry for imperceptible supervision is not limited to the components listed above.

The microcontroller 315 controls the length of the pulse or flash on and off of the one or more LEDs 401. A flash may be a short flash or pulse. A short flash may be an "invisible" flash as it is of too short a duration to be detected or seen by a human. For example, one or more LEDs may be activated for a pulse width, such as, but not limited to, 1 microsecond, 5 microseconds, 10 microseconds, 15 microseconds and/or 20 microseconds. The one or more LEDs may be activated for a time period of less than 15 microseconds. The microcontroller 315 causes a driver circuit 320 to activate it associated LEDs without detection by a human.

Alternatively, or in addition, the microcontroller 315 controls the driver circuit 320 to reduce the current supplied to the LED 301. The diver circuit 320 may include, but is not limited to a transistor. The current supplied to the LED may be reduced by reducing the pulse-width modulation (PWM) duty cycle using either a PWM controller (not shown) or duty cycling the LED directly from the microcontroller 315. Alternatively, the current may be reduced by using a digital/analog (D/A) circuit and the output voltage controlling a voltage controlled current driver circuit. The current may be reduced to a percentage of the normal drive current. For example, a current may be supplied that is 5% of the normal alarm current drive. The current drive may be a fraction of, or a percentage of, a percent of the normal current drive. The reduction in current may be to any value needed, from less than 1 percent to the normal 100% drive current. The current may be set as needed to achieve an imperceptible flash of the LEDs. The current may be reduced in order to reduce the intensity of the activated LED. The reduced intensity may be imperceptible to a human.

The microcontroller 315 initiates a flash test and/or reduced current test to determine the operability of one or more LEDs 301. The microcontroller 315 automatically causes transistor 320 to activate the LEDs after the LEDs are installed. A factory where the LEDs are created may initiate the activation of the LEDs after installation by using hardware button, etc. In addition or alternatively, the microcontroller 315 may automatically cause transistor 320 to activate the LEDs after a certain period of time. The microcontroller 325 may activate the one or more LEDs once a year, semi-annually, monthly, bimonthly, and/or other periodic or random periods of time. LEDs may be activated simultaneously and/or each LED may be activated individually.

The microcontroller 315 may control the LEDs directly. Alternatively, the microcontroller 315 may receive an indication as to when the LEDs are activated. Based on the indication, the microcontroller compares the photodetector output to a threshold, as discussed below.

The photodetector 325 may be associated with one or more LEDs. The photodetector 325 provides an indication of the intensity of light emitted from the one or more LEDs 301. The microcontroller 315 determines the intensity and/or degradation of the one or more LEDs 301 and the photodetector 325 generates an electrical signal for each light emitted from the one or more LEDs 301. The photodetector 325 sends the results of activating the one or more LEDs to the microcontroller 315. The results indicate whether each LED 301 tested is operational.

The microcontroller 315 may be connected to the photodetector 325 and the one or more LEDs 301. The microcontroller 315 may be, but is not limited to, a microprocessor, field-programmable gate array (FPGA) and/or other integrated circuit devices or even hard-wired circuitry. The microcontroller 315 receives the one or more electrical signals from the photodetector 325. The microcontroller 315 may determine whether the LED associated with the electrical signal is operational. The microcontroller 315 may determine whether the electrical signal is operational by determining whether the electrical signal associated with the LED is greater than or equal to a minimum signal strength. A minimum signal strength may be a threshold amount of light that is needed from the LED. For example, a minimum signal strength may be a signal strength greater than zero. For example, a minimum signal strength may be based on light intensity standards, such as, but not limited to, UL 1971—Signaling Devices for the Hearing Impaired. A minimum signal strength may vary based on the type of LED. For example, different strobe lights use different LEDS. The minimum signal strength measured by the microcontroller may be a voltage between about 0V and about 5V. The minimum signal strength may be a relative value correlated to an absolute value. For example, 4.5V could be the minimum signal strength for 110 candela, while 1V may be the minimum signal strength for 15 candela. The microcontroller may verify that the measured output corresponds to at least the rated output of the device. If a reduced current was used to test the LED 301, then the microcontroller 315 may use a proportional calculation in determining whether the electrical signal associated with the LED 301 is greater than a minimum signal. For example, if the drive current was reduced to 5% for testing, then when comparing the intensity of the measured electrical signal associated with the LED to a minimum signal, the minimum signal strength may be decreased or reduced to 5%. As another example, the measured value may be reduced by 90% reduced from the normal output value.

If the LED failed to operate correctly and/or its associated output intensity as detected by the photodetector was not higher than or equal to the threshold signal strength, a microcontroller 315 may observe no change in the measuring circuit. The microcontroller 315 may report one or more non-functioning LEDs or display device. Such failure may be the result of an LED failing to operate.

Figure 4:
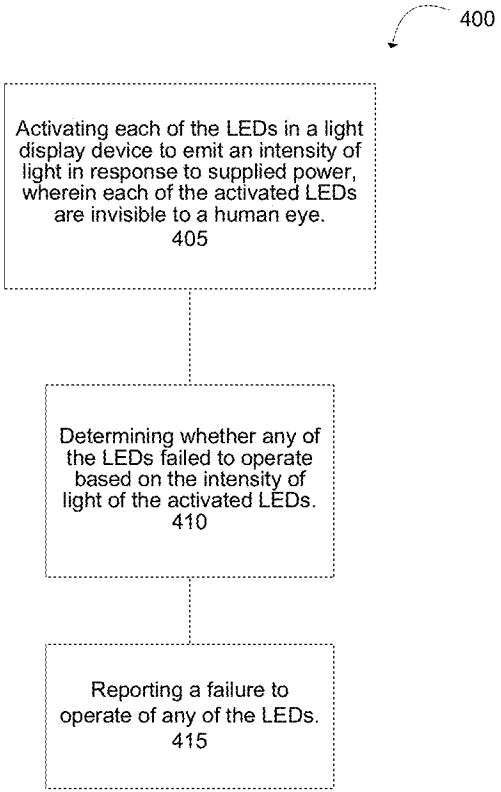
FIG. 4 illustrates one embodiment of a logic diagram for imperceptible supervision in the light display device.

FIG. 4 illustrates one embodiment of a logic diagram for imperceptible supervision in the light display device. Logic flow 400 may be representative of the operations executed by one or more embodiments described herein. As shown in logic flow 400, each LED in a light display device may be activated to emit an intensity of light in response to supplied power at step 405. Light emitted from each activated LED may be imperceptible to a human. Each activated LED may only be turned on for a pulse or flash. One or more LEDs may be activated simultaneously or individually. Each LED may be automatically activated after fabrication and/or after a set period. Activating each LED in a dome light display device may include activating the one or more LEDs for a pulse width which is imperceptible or undetectable to a human. Each LED may be activated, flashed and/or turned on for a pulse width or time period of between about 1 to about 15 microseconds using the transistor. Alternatively, or in addition, activating each LED in a dome light display device may include reducing a drive current supplied to the one or more LEDs. By reducing the current, the flash may be imperceptible to a human.

It may be determined whether any of the one or more LEDs failed to operate based on the intensity of light of the one or more activated LEDs at step 410. A microcontroller may determine whether an electrical signal associated with the intensity of light of the one or more LEDs is greater than a minimum signal. A microcontroller may observe no change in a measuring circuit when an LED failed to operate. Failure to operate is indicated when the electrical signal associated with the intensity of the LED is not at or above a threshold level.

A failure to operate of any of the one or more LEDs is reported at step 415. The microcontroller reports any failure of any of the LEDs.

Numerous specific details have been set forth herein to provide a thorough understanding of the embodiments so as to be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

Some embodiments may be implemented, for example, using a machine-readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

While the present invention has been disclosed with reference to certain embodiments, numerous modifications, alterations and changes to the described embodiments are possible without departing from the sphere and scope of the present disclosure, as defined in the appended claims. Accordingly, it is intended that the present invention not be limited to the described embodiments, but that it has the full scope defined by the language of the following claims, and equivalents thereof.

The invention claimed is:

1. A method for determining operability of a LED in a light display device, comprising:

initiating a reduced current test by activating the LED with a reduced drive current relative to a normal drive current to cause the LED to begin emitting light, the light emitted with an intensity that is imperceptible to a human;

sensing an intensity of light emitted from the LED; and determining whether the LED is operational by comparing said sensed intensity with a predetermined intensity value.

2. The method of claim 1, wherein determining whether the LED is operational comprises determining whether an electrical signal associated with an intensity of the light emitted by the LED is greater than a minimum signal.

3. The method of claim 1, wherein the step of activating the LED further comprises activating the LED in a dome lamp.

4. The method of claim 1, wherein the step of activating the LED further comprises activating the LED in an emergency notification strobe.

5. The method of claim 1, wherein the step of activating the LED further comprises automatically activating the LED after a predetermined period.

6. The method of claim 1, wherein activating the LED comprises activating a plurality of LEDs simultaneously, and wherein obtaining results of the activation comprises measuring an output of the plurality of LEDs collectively.

7. The method of claim 1, wherein activating the LED comprises activating a plurality of LEDs simultaneously, and wherein obtaining results of the activation comprises measuring a collective output of less than all of the plurality of LEDs.

8. The method of claim 1, wherein activating the LED with a reduced drive current comprises reducing a pulse-width modulation duty cycle of the LED.

9. The method of claim 1, wherein activating the LED further comprises turning the LED on for a time period of less than 20 microseconds.

10. The method of claim 1, wherein activating the LED further comprises activating the LED for a pulse width which is imperceptible to a human.

11. The method of claim 1, wherein activating the LED further comprises activating the LED for an amount of time that is imperceptible to a human.

12. A device comprising:

a LED;

a driver circuit connected to the LED; and a microcontroller connected to said driver circuit and the LED, said microcontroller configured to initiate a reduced current test to determine the operability of the LED, wherein during the reduced current test the microcontroller is configured to:

activate the LED via the driver circuit with a reduced drive current relative to a normal drive current to cause the LED to begin emitting light, the light emitted with an intensity that is unable to be detected by a human;

receive an indication when the LED is activated;

obtain results of the activation; and determine whether the LED is operational.

13. The device of claim 12, further comprising a photodetector disposed adjacent the LED, the photodetector configured to detect an intensity of light emitted from the LED and to send an electrical signal indicative of the intensity to the microcontroller.

14. The device of claim 12, wherein determining whether the LED is operational comprises determining whether the electrical signal is greater than a minimum signal.

15. The device of claim 12, wherein activating the LED comprises turning on the LED for less than 20 microseconds.

16. The device of claim 12, wherein the device includes a plurality of said LEDs, and the microcontroller is configured to simultaneously activate the plurality of LEDs using a reduced duty cycle.

17. The device of claim 12, wherein the device includes a plurality of said LEDs, and the microcontroller is configured to simultaneously activate the plurality of LEDs and to obtain results of the activation by measuring an output of the plurality of LEDs collectively.

18. The device of claim 12, wherein the device includes a plurality of said LEDs, and the microcontroller is configured to simultaneously activate the plurality of LEDs to obtain results of the activation by measuring a collective output of less than all of the plurality of LEDs.

19. The device of claim 12, wherein the reduced drive current is 5% of the normal drive current.

20. The device of claim 12, wherein the microcontroller is configured to initiate the reduced current test automatically on a periodic basis.

21. A method for determining operability of a LED in a light display device, comprising:

initiating a reduced current test by activating the LED with a reduced drive current relative to a normal drive current to cause the LED to begin emitting light, the light emitted with a reduced intensity as compared to a normal operating intensity;

sensing an intensity of light emitted from the LED; and determining whether the LED is operational by comparing said sensed intensity with a predetermined intensity value.

22. The method of claim 21, wherein the reduced drive current is less than or equal to 5% of the normal drive current.

23. The method of claim 21, wherein the reduced drive current is less than or equal to 10% of the normal drive current.

24. The method of claim 21, wherein the reduced intensity light is imperceptible to a human.

25. A method comprising:

initiating a flash test to determine the operability of a LED in a light display device, wherein the flash test comprises one of activating the LED for a time period of less than about 15 microseconds and activating the LED for a pulse width of 20 microseconds or less; wherein the flash test reduces a drive current relative to a normal drive current to cause the LED to begin emitting light, and wherein the light is emitted with an output intensity that is imperceptible to a human; and determining whether the LED failed to operate based on the output intensity of the flash of light emitted by the LED.

26. The method of claim 25, wherein determining whether the LED failed to operate comprises determining, by a control circuit, whether an electrical signal associated with the output intensity of the flash of light of the LED is greater than a minimum signal.

27. The method of claim 25, wherein the flash of light emitted by the LED during the flash test is imperceptible to a human.

* * * * *